US005581618A

United States Patent [19]

Satoshi et al.

[11] Patent Number: 5,581,618

[45] Date of Patent: Dec. 3, 1996

[54] SOUND-IMAGE POSITION CONTROL APPARATUS

[75] Inventors: Sekine Satoshi; Junichi Fujimori; Yasutake Suzuki, all of Hamamatsu, Japan

[73] Assignee: Yamaha Corporation, Hamamatsu, Japan

[21] Appl. No.: 379,771

[22] Filed: Jan. 27, 1995

Related U.S. Application Data

[63] Continuation of Ser. No. 41,818, Apr. 1, 1993, abandoned.

[30] Foreign Application Priority Data

| | | | |
|---|---|---|---|
| Apr. 3, 1992 | [JP] | Japan | 4-082457 |
| Apr. 18, 1992 | [JP] | Japan | 4-125675 |
| Jan. 29, 1993 | [JP] | Japan | 5-014287 |

[51] Int. Cl.[6] ..... H04S 5/00

[52] U.S. Cl. ..... 381/17

[58] Field of Search ..... 381/17,18

[56] References Cited

U.S. PATENT DOCUMENTS

| | | | |
|---|---|---|---|
| 3,826,566 | 7/1974 | Csontos . | |
| 3,919,478 | 11/1975 | Schott . | |
| 4,018,992 | 4/1977 | Olson . | |
| 4,219,696 | 8/1980 | Kogure et al. | 381/1 |
| 4,308,423 | 12/1981 | Cohen | 381/1 |
| 4,495,637 | 1/1985 | Bruney | 381/1 |
| 4,685,134 | 8/1987 | Wine . | |
| 5,027,689 | 7/1991 | Fujimori | 84/622 |
| 5,052,685 | 10/1991 | Lowe et al. . | |
| 5,105,462 | 4/1992 | Lowe et al. . | |
| 5,198,604 | 3/1993 | Higashi et al. | 84/626 |

FOREIGN PATENT DOCUMENTS

| | | |
|---|---|---|
| 0357402 | 3/1990 | European Pat. Off. . |
| 263235 | 12/1990 | Japan . |
| 4150400 | 5/1992 | Japan . |

OTHER PUBLICATIONS

Patent Abstracts of Japan, vol. 14, No. 55 (E–882) 31 Jan. 1990: JP–A–01 279 700, Acoustic Signal Processor (Washisawa) 9 Nov. 1989.

Patent Abstracts of Japan, vol. 14, No. 95 (E–892) 21 Feb. 1990: JP–A–01 300 700, Signal Field Variable Device (Tagami) 5 Dec. 1989.

EP–A–0 393 702 (Yamaha), Signal Delay Circuit, FIR Filter and Musical Tone Synthesizer Employing the Same (Yamauchi, et al.) 24 Oct. 1990.

*Primary Examiner*—Forester W. Isen

*Attorney, Agent, or Firm*—Loeb & Loeb LLP

[57] ABSTRACT

In order to obtain a sound-broadened image and a clear sound-image discrimination image when producing plural kinds of sounds, the electronic musical instrument and the like provides a sound-image position control apparatus. This apparatus at least provides a signal mixing portion (e.g., matrix controller) and a virtual-speaker position control portion. Herein, the signal mixing portion mixes plural audio signals supplied from a sound source and the like in accordance with a predetermined signal mixing procedure so as to output plural mixed signals. In order to control positions of virtual speakers which are emerged as sound-producing points as if each kind of sounds is produced from each of these points, the virtual-speaker position control portion applies different delay times to each of plural mixed signals so as to output delayed signals as right-side and left-side audio signals to be respectively supplied to right-side and left-side speakers. Thus, the sound-image positions formed by the virtual speakers are controlled well, so that the person can clearly discriminate and recognize each of the sound-image positions. When applying this apparatus to the game device providing a display unit which displays an animated image representing a visual image of the air plane and the like, by adequately controlling the sound-image position, it is possible to obtain a brand-new live-audio effect, by which the point of producing the sounds corresponding to the animated image can be moved in accordance with the movement of the animated image which is moved by the player of the game.

14 Claims, 11 Drawing Sheets r: RADIUS OF HEAD OF PERSON M d: DISTANCE BETWEEN SOUND SOURCE AND CENTER OF HEAD dr: DISTANCE BETWEEN RIGHT EAR AND SOUND SOURCE $dr \cdot dr = r \cdot r + d \cdot d - 2rd\sin\theta$ dl: DISTANCE BETWEEN LEFT EAR AND SOUND SOURCE $dl \cdot dl = r \cdot r - d \cdot d + 2rd\sin\theta$

O: CENTER OF HEAD OF PERSON M

SOUND-IMAGE POSITION CONTROL APPARATUS

This is a continuation of application Ser. No. 08/041,818 filed Apr. 1, 1993, now abandoned.

BACKGROUND OF THE INVENTION

1. Field of the Invention

The present invention relates to a sound-image position control apparatus which is suitable for use in the electronic musical instruments, audio-visual devices and the like so as to eventually perform the sound-image localization.

2. Prior Art

As the devices which offers the person the sound-broadened image, there are provided the stereo-chorus device, reverberation device and the like. Herein, the former one is designed to produce the sound of which phase is slightly shifted as compared to that of the original sound so that this phase-shifted sound and the original sound are alternatively produced from the left and right loud-speakers, while the latter one is designed to impart the reverberation effect to the sounds.

In addition, there is another device, called the panning device. This panning device is designed to provide the predetermined output-level difference between the sounds which are respectively produced from the left and right loud-speakers, resulting that the stereophonic effect or stereo-impressive image is applied to the sounds.

The above-mentioned stereo-chorus device or reverberation device can enlarge the sound-broadened image. However, there is a drawback in that the sound-distribution image which is sensed by the listener must become unclear when enlarging the sound-broadened image. Herein, the sound-distribution image is defined as a degree of discrimination in which the person who listens to the music from the audio device can specifically discriminate the sound of certain instrument from the other sounds. For example, when listening to the music played by the guitar and keyboard by the audio an device having a relatively good sound-distribution image control, the person can discriminate the respective sounds as if the guitar sound is produced from the predetermined left-side position, while the keyboard sound is produced from the predetermined right-side position (hereinafter, such virtual position will be referred to as the sound-image position). When listening to the music by use of the aforementioned stereo-chorus device or reverberation device, it is difficult for the person to clearly discriminate the sound-image positions.

In the panning device, the sound-image position must be fixed at the predetermined position disposed on the line connecting the left and right loud-speakers on the basis of the sound-image localization technique, resulting that the sound-broadened image cannot be substantially obtained. In other words, when simultaneously producing plural sounds each having a different sound-image position, the panning device merely functions to roughly mix up those sounds so that the clear sound-image positions cannot be obtained.

In the meantime, the panning device is frequently equipped with or built in the electronic musical instrument when simulating the sounds of the relatively large-scale instruments such as the piano, organ and vibraphone. In such instrument (e.g., piano), the sound-producing positions must be moved accompanied with the progression of notes, thus, the panning device functions to simulate such movement of the sound-producing positions.

However, the panning device also suffers from the aforementioned drawback. More specifically, the panning device can offer certain degree of panning effect when simulating the sounds, however, it is not possible to clearly discriminate the sound-image position of each of the sounds to be produced. In short, the panning device cannot perform the accurate simulation with respect to the discrimination of the sound-image positions.

SUMMARY OF THE INVENTION

It is accordingly a primary object of the present invention to provide a sound-image position control apparatus by which even when simultaneously producing plural sounds each having a different sound-image position, it is possible to clearly discriminate the sound-image position of each of the sounds to be produced.

It is another object of the present invention to provide a sound-image position control apparatus which can offer the sound-broadened effect, stereophonic effect or stereo-impressive image when simultaneously producing plural sounds each having a different sound-image position.

It is a further object of the present invention to provide a sound-image position control apparatus which can offer a sound-image localization with a simple configuration of the apparatus.

According to the fundamental configuration of the present invention, the sound-image position control apparatus comprises a signal mixing portion and a virtual-speaker position control portion. Herein, the signal mixing portion mixes plural audio signals supplied thereto in accordance with a predetermined signal mixing procedure so as to output plural mixed signals. The virtual-speaker position control portion applies different delay times to each of plural mixed signals so as to output delayed signals as right-side and left-side audio signals to be respectively supplied to right-side and left-side speakers. In this case, some virtual speakers are virtually emerged as sound-producing points as if each of the sounds is produced from each of these points. Thus, sound-image positions formed by the virtual speakers are controlled in accordance with plural mixed signals.

Under effect of the aforementioned configuration of the present invention, the sounds applied with the stereophonic effect and clear sound-image discrimination effect are to be actually produced from the right-side and left-side speakers as if the sounds are virtually produced from the virtual speakers of which positions are determined under control of the virtual-speaker position control portion.

When applying this apparatus to the game device providing a display unit which displays an animated image representing an image of the air plane and the like, by adequately controlling the sound-image position, it is possible to obtain a brand-new live-audio effect, by which the point of producing the sounds corresponding to this animated image is moved in accordance with the movement of the animated image which is moved by the player of the game.

Moreover, the present invention can be easily modified to be applied to the movie system or video game device in which the sound-image position is controlled responsive to the video image. This system comprises an audio/video signal producing portion; a scene-identification signal producing portion; a plurality of speakers; a sound-image forming portion; and a control portion.

The above-mentioned scene-identification signal producing portion outputs a scene-identification signal in response to a scene represented by the video signal. The sound-image forming portion performs the predetermined processings on the audio signals so as to drive the speakers. Under effect of such signal processings, the speakers produce the sounds of which sound-image positions are fixed at the desirable positions departing from the linear spaces directly connecting the speakers. The control portion controls the contents of the signal processings so as to change over the fixed sound-image position in response to the scene-identification signal.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

Figure 4:
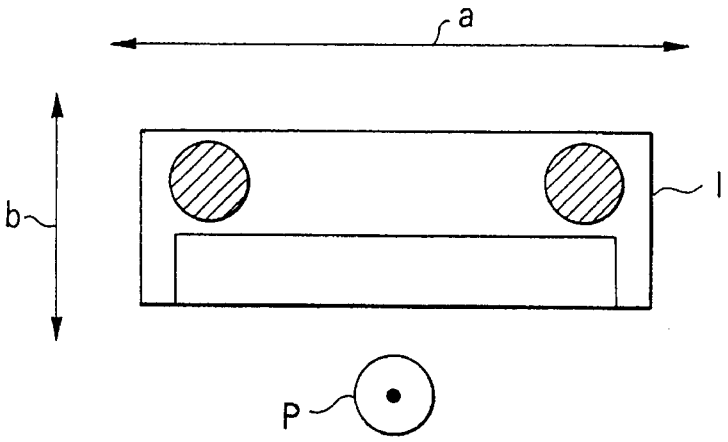
FIG. 4 is a plan view illustrating a fundamental position relationship between the performer and speakers according to the present invention.

Now, description will be given with respect to the embodiments of the present invention by referring to the drawings, wherein the predetermined position relationship is fixed between a performer P and an instrument I as shown in FIG. 4. In the description, the lateral direction indicates an arrow direction "a", while the longitudinal direction indicates an arrow direction "b" as shown in FIG. 4.

[A] First Embodiment (1) Configuration

Figure 1A:
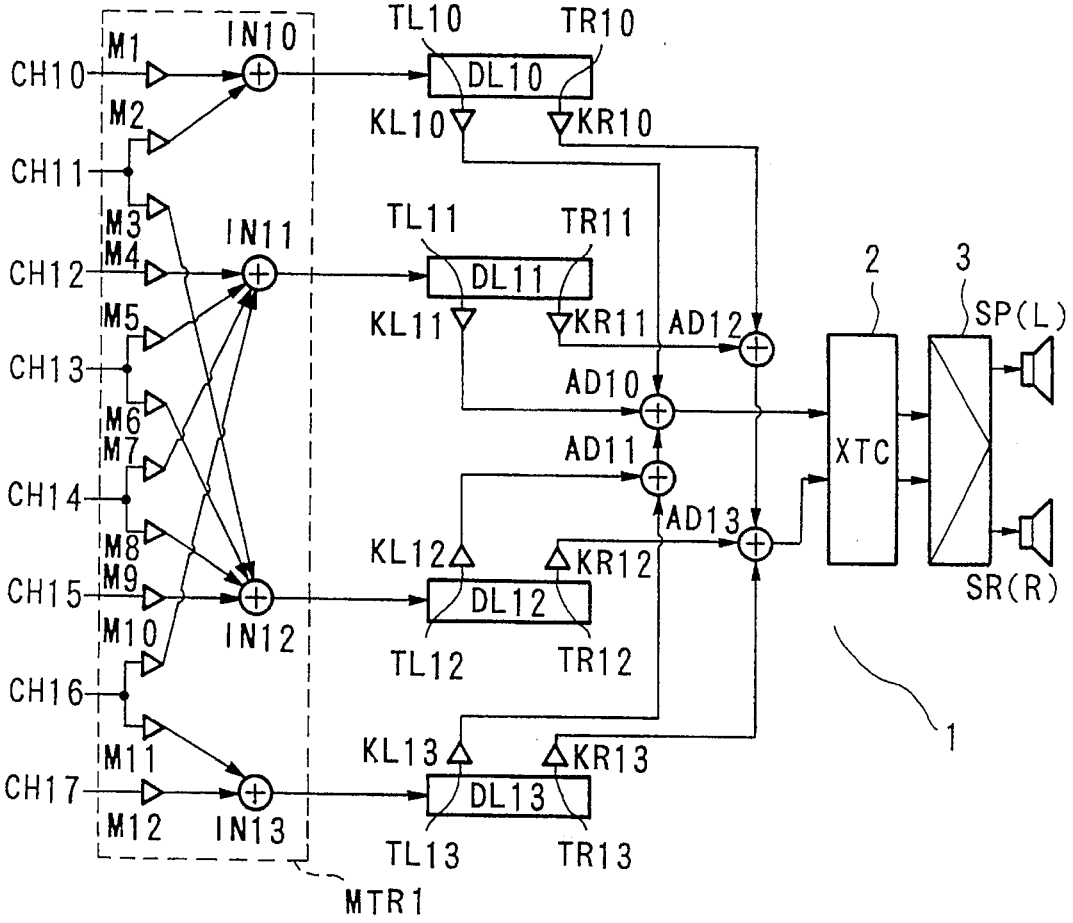
FIG. 1(A) is a block diagram showing an electronic configuration of a sound-image position control apparatus according to a first embodiment of the present invention.
Figure 1B:
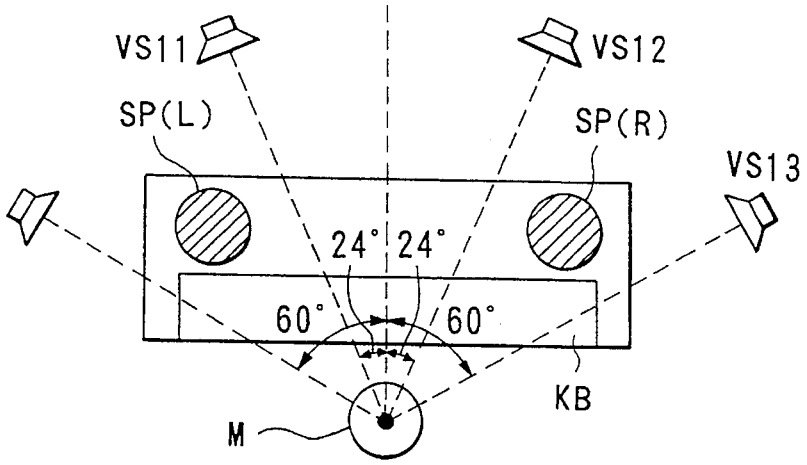
FIG. 1(B) is a plan view illustrating a position relationship between the performer and speakers.

FIG. 1(B) is a plan view illustrating a position relationship between a person M (i.e., performer) and an electronic musical instrument containing two speakers (i.e., loud-speakers). Herein, KB designates a keyboard providing plural keys, wherein when depressing a key, a tone generator (not shown) produces a musical tone waveform signal having the pitch corresponding to the depressed key. SP(L) and SP(R) designate left and right speakers respectively. These speakers SP(L), SP(R) are respectively arranged at the predetermined left-side and right-side positions of the upper portion of the instrument.

FIG. 1(A) is a block diagram showing an electronic configuration of a sound-image position control apparatus 1 according to a first embodiment of the present invention. This apparatus 1 provides eight channels respectively denoted by numerals Ch10 to Ch17 (given with a general numeral "Ch"), wherein each channel Ch receives the musical tone waveform signal produced from the tone generator. Specifically, the musical tone waveform signal supplied to each channel Ch has the allocated frequency domain corresponding to some musical notes (hereinafter, referred to as the allocated tone area).

More specifically, the allocation of the tone areas is given as follows: the musical tone waveform signal of which tone area corresponds to the lowest-pitch note to C1 note is supplied to the channel Ch10, while the musical tone waveform signal of which tone area corresponds to C#1 note to C2 note is supplied to the channel Ch11. Similarly, the tone area of C#2 to F2 is allocated to the channel Ch12; the tone area of F#2 to C3 is allocated to the channel Ch13; the tone area of C#3 to F3 is allocated to the channel Ch14; the tone area of F#3 to C4 is allocated to the channel Ch15; the tone area of C#4 to C#5 is allocated to the channel Ch16; and the tone area corresponding to the D5 note to the highest-pitch note is allocated to the channel Ch17.

Next, M1 to M12 designate multipliers which multiply the musical tone waveform signal supplied thereto by respective coefficients CM1 to CM12. IN10 to IN13 designate adders, each of which receives the outputs of some multipliers. The above-mentioned elements, i.e., multipliers M1 to M12, adders IN10 to IN13 and channels Ch10 to Ch17 are assembled together into a matrix controller MTR1. Herein, the connection relationship and arrangement relationship among those elements of the matrix controller MTR1 can be arbitrarily changed in response to the control signal and the like. Incidentally, the detailed explanation of this matrix controller MTR1 will be given later.

Meanwhile, DL10 to DL13 designate delay circuits which respectively delays the outputs of the adders IN10 to IN13. Each of them has two output terminals each having a different delay time.

The signal outputted from a first output terminal TL10 of the delay circuit DL10 is multiplied by the predetermined coefficient by a multiplier KL10, and then the multiplied signal is supplied to a first input (i.e., input for the left-side speaker) of a cross-talk canceler 2 via an adder AD10. On the other hand, the signal outputted from a second output terminal TR10 of the delay circuit DL10 is multiplied by the predetermined coefficient by a multiplier KR10, and then the multiplied signal is supplied to a second input (i.e., input for the right-side speaker) of the cross-talk canceler 2 via adders AD12, AD13.

Similarly, the signal outputted from a first terminal TL11 of the delay circuit DL11 is eventually supplied to the first input of the cross-talk canceler 2 via a multiplier KL11 and the adder AD10, while another signal outputted from a second terminal TR11 of the delay circuit DL11 is eventually supplied to the second input of the cross-talk canceler 2 via a multiplier KR11 and the adders AD12, AD13. The signal outputted from a first terminal TL12 of the delay circuit DL12 is eventually supplied to the first input of the cross-talk canceler 2 via a multiplier KL12 and the adder AD11, AD10, while another signal outputted from a second terminal TR12 of the delay circuit DL12 is eventually supplied to the second input of the cross-talk canceler 2 via a multiplier KR12 and the adder AD13. Lastly, the signal outputted from a first terminal TL13 of the delay circuit DL13 is eventually supplied to the first input of the cross-talk canceler 2 via a multiplier KL13 and the adders AD11, AD10, while another signal outputted from a second terminal TR13 of the delay circuit DL13 is eventually supplied to the second input of the cross-talk canceler 2 via a multiplier KL13 and the adder AD13.

Figure 3A:
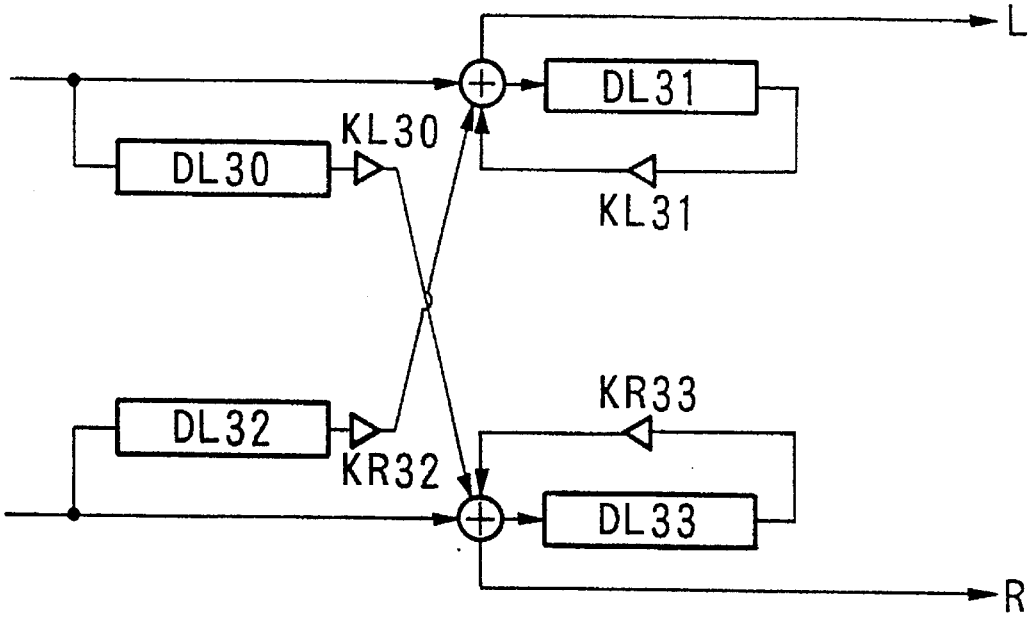
FIG. 3(A) is a block diagram showing a detailed electronic configuration of a cross-talk canceler shown in FIG. 1(A)
Figure 3B:
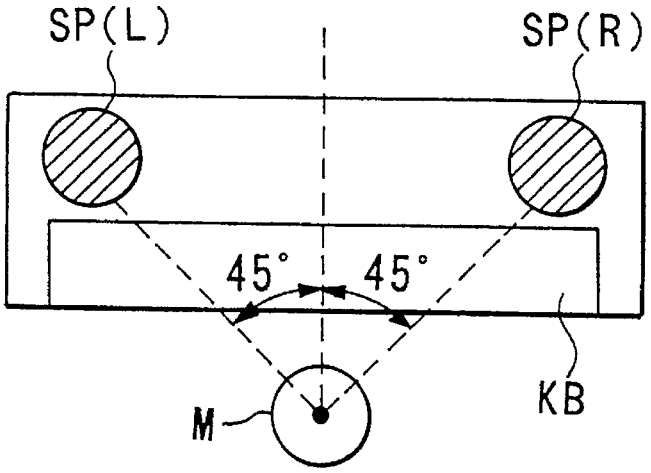
FIG. 3(B) is a plan view illustrating another example of the position relationship between the performer and speakers.

The above-mentioned cross-talk canceler 2 is designed to cancel the cross-talk sounds which are emerged when the person hears the sounds with his both ears. In other words, this is designed to eliminate the cross-talk phenomenon in which the right-side sound is entered into the left ear, while the left-side sound is entered into the right ear. FIG. 3(A) shows an example of the circuitry of this cross-talk canceler 2. This circuit is designed on the basis of the transfer function of head which is obtained through the study of the sound transmission between the human ears and dummy head (i.e., virtual simulation model of the human head). On the basis of the experimental values obtained through the transfer function of head, the study is made to compute the sound-arrival time differences between the left and right ears and the peak values of the impulse response of the transfer function. In response to these values, this circuitry performs the delay operations and weight functional caluculus.

The observation is made on the model wherein both of the speakers SP(L), SP(R) are positioned apart from the person M by 1.5 m respectively and they are also respectively arranged at the predetermined left-side and right-side positions each of which direction is deviated from the front direction of the person M by 45°. Since the foregoing transfer function of head of the person M is the symmetrical function, one of the speaker SP(L), SP(R) is sounded so as to actually measure the sound-arrival time difference between the left and right ears and the peak values of the impulse response. Herein, coefficients of multipliers and delay times of delay circuits in the circuitry shown in FIG. 3(A) are determined on the basis of the result of the measurement. For example, when the result of the measurement indicates that the left/right level difference is at 6 dB (or 0.5) and the left/right time difference is at 200 μs, the same coefficient "−0.5" is applied to multipliers KL30, KR32, while the same delay time 200 μs is set to delay circuits DL30, DL32. Incidentally, the other circuit elements in FIG. 3(A), i.e., delay circuits DL31, DL33 and multipliers KL31, KR33 configure the all-pass filter which is provided to perform the phase matching.

As shown in FIG. 1(A), the left and right output signals of the cross-talk canceler 2 are amplified by an amplifier 3 and then supplied to the left and right speakers SP(L), SP(R), from which the corresponding left/right sounds are produced. When listening to the sounds which are produced by means of the cross-talk canceler 2, the cross talk is canceled, resulting that the clear sound separation between the left/right speakers is achieved.

Next, the description will be given with respect to the functions of the delay circuits DL10–DL13. In case of the delay circuit DL10, the signal outputted from the terminal TR10 is multiplied by the predetermined coefficient in the multiplier KR10, and consequently, the multiplied signal will be converted into the musical sound by the right speaker SP(R). On the other hand, the signal outputted from the terminal TL10 is multiplied by the predetermined coefficient in the multiplier KL10, and consequently, the multiplied signal will be converted into the musical sound by the left speaker SP(L). In this case, the sound-image position is determined by two factors, i.e., the difference between the delay times of the sounds respectively produced from the right and left speakers, and the ratio between the tone volumes respectively applied to the left and right speakers. Since the present embodiment can set the above-mentioned delay-time difference in addition to the above-mentioned tone-volume ratio, the sound-image position can be set at certain position which is far from the speakers SP(L), SP(R) and which departs from the line connecting these speakers. In short, it is possible to set the sound-image position in the arbitrary space which departs from the linear space connecting the speakers. In other words, the virtual speakers which are not actually existed are placed at the arbitrary spatial positions, so that the person can listen to the sounds which are virtually produced from those positions. In the present embodiment, the delay circuit DL10 functions to set the virtual sound-producing position at VS10 (see FIG. 1(B)), which is called as the virtual speaker.

Similarly, the other delay circuits DL11, DL12, DL13 respectively correspond to the virtual speakers VS11, VS12, VS13 as shown in FIG. 1(B). As shown in FIG. 1(B), these virtual speakers VS10, VS11, VS12, VS13 are respectively and roughly arranged along with a circular line which can be drawn about the performer. When drawing the center line between the performer (i.e., circle center) and respective one of the virtual speakers VS10, VS11, VS12, VS13, there are formed four circular angles, 60°, 24°, 24° and 60° as shown in FIG. 1(B).

Next, the description will be given with respect to the functions of the matrix controller MTR1. As described before, this matrix controller MTR1 is designed to control the connection relationship and arrangement relationship among the multipliers M1–M12, adders IN10–IN13 and channels Ch10–Ch17. Such control indicates how to assign the signals of the channels Ch10–Ch17 to the virtual speakers VS10–VS13. Thus, the sound-image position of each channel Ch can be determined by the ratio of each channel-output signal applied to each virtual speaker. In other words, the panning control is carried out on the virtual speakers VS10–VS13 respectively, thus controlling the sound-image position with respect to each channel.

In the present embodiment as shown in FIG. 1(A), the allocation ratio of the each channel-output signal applied to each virtual speaker is controlled by setting the coefficients of the multipliers M1–M12 as follows: CM1=0.75 (by being multiplied by this coefficient, the tone volume of the musical tone waveform signal is reduced by 2.5 dB), CM2=0.75, CM3=0.25 (by being multiplied by this coefficient, the tone volume of the musical tone waveform signal is reduced by 12 dB), CM4=0.75, CM5=0.625 (by being multiplied by this coefficient, the tone volume of the musical tone waveform signal is reduced by 4.08 dB), CM6=0.313 (which is equivalent to the reduction of 10.08 dB in the tone volume of the musical tone waveform signal), CM7=0.313, CM8=0.625, CM9=0.75, CM10=0.25, CM11=0.75, CM12=0.75.

Figure 2A:
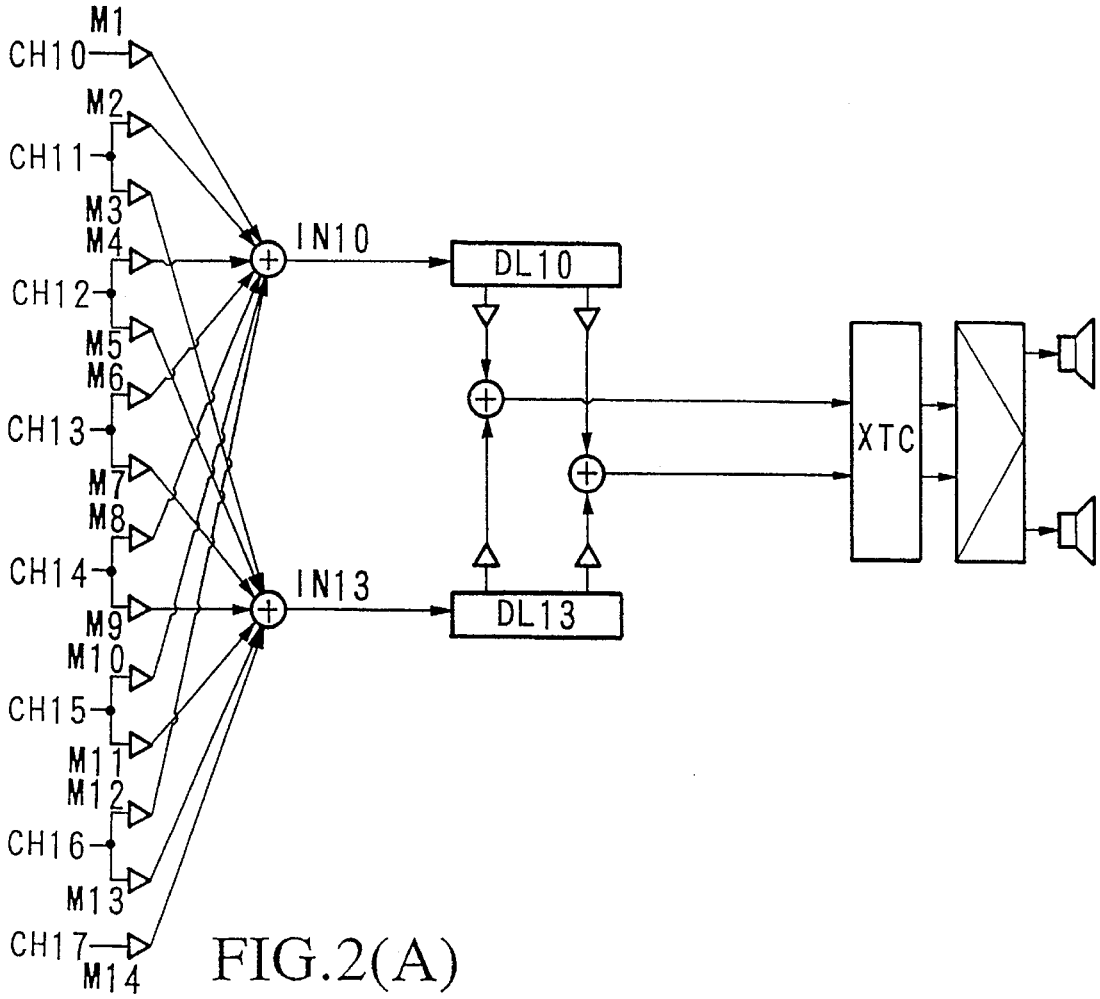
FIG. 2(A) is a block diagram showing another example of the arrangement of circuit elements in a matrix controller.
Figure 2B:
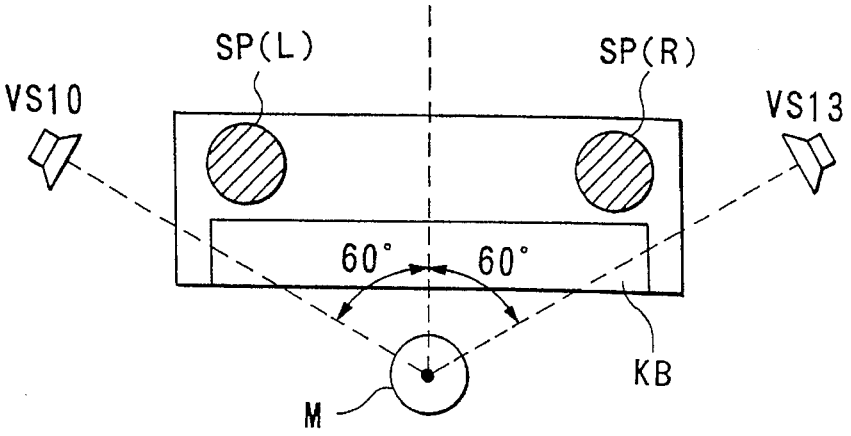
FIG. 2(B) is a plan view illustrating another example of the position relationship between the performer and speakers.

FIG. 2(A) shows another example of the arrangement and connection among the multipliers and adders under control of the matrix controller MTR1. In this example, only two delay circuits DL10, DL13 are used for the virtual speakers. In short, as shown in FIG. 2(B), two virtual speakers VS10, VS13 are used for the production of the musical sounds. Herein, under control of the matrix controller MTR1, some of the signals of the channels Ch10–Ch17 are adequately allocated to each of the adders IN10, IN13 so as to control the sound-image positions. In this example, the coefficients of the multipliers M1–M14 are respectively set as follows: CM1=0.75, CM2=0.75, CM3=0.313, CM4=0.625, CM5=0.375 (by being multiplied by this coefficient, the tone volume of the musical tone waveform signal is reduced by 8.5 dB), CM6=0.5 (which is equivalent to the reduction of 6 dB in the tone volume of the musical tone waveform signal), CM7=0.439 (which is equivalent to the reduction of 7.16 dB in the tone volume of the musical tone waveform signal), CM8=0.439, CM9=0.5, CM10=0.375, CM11=0.625, CM12=0.313, CM13=0.75, CM14=0.75.

(2) Operation

Next, the description will be given with respect to the operation of the present embodiment.

When the performer P plays the keyboard to perform the music, the musical tone waveform signal is produced in response to each of the keys depressed by the performer. Then, the musical tone waveform signals are respectively allocated to the channels on the basis of the predetermined tone-area allocation manner, so that these signals are eventually entered into the matrix controller MTR1. Assuming that the circuit elements of the matrix controller MTR1 are arranged and connected as shown in FIG. 1(A), the musical tone waveform signals are produced as the musical sounds from the virtual speakers VS10–VS13 in accordance with their tone areas.

The detailed explanation can be described as follows. First of all, the musical tone waveform signals corresponding to the tone area between the lowest-pitch note and C1 note (see Ch10) are produced as the musical sounds from the virtual speaker VS10. In addition, the musical tone waveform signals corresponding to the tone area between the C#1 note and C2 note (see Ch11) are produced as the musical sounds from the virtual speakers VS12, VS10. However, due to the coefficients of the multipliers M2, M3, the sound-image positions corresponding to those notes are placed close to the virtual speaker VS10. More specifically, these sound-image positions are arranged on the line connecting the virtual speakers VS12, VS10, but they are also located close to the virtual speaker VS10. Further, the musical tone waveform signals corresponding to the tone area between the C#2 note to F2 note (see Ch12) are produced as the musical sounds from the virtual speaker VS11. Similarly, the other musical tone waveform signals corresponding to each the other tone areas (i.e., each of the other channels) are eventually produced as the musical sounds from the predetermined one or two virtual speakers at certain sound-image positions. Thus, the sound-image positions corresponding to the tone areas which are respectively arranged from the lowest pitch to the highest pitch are sequentially arranged from the left-side position to the right-side position along with a circular line drawn about the performer P (see FIG. 1(B)). As a result, when the performer P sequentially depress the keys from the lower pitch to the higher pitch, the sound-image positions are sequentially moved from the left-side position to the right-side position along with the above-mentioned circular line. In short, it is possible to control the left/right and front/back positionings of the sound images.

On the other hand, when the circuit elements of the matrix controller MTR1 are arranged and connected as shown in FIG. 2(A), the musical tone waveform signals of each tone area are eventually produced as the musical sounds from one or both of the virtual speakers VS10, VS13. Thus, the positioning control of the sound images are controlled on the line connecting these virtual speakers. In this case, the control of the front/backside sound-broadened image is poor as compared to that of FIG. 1(A). However, as comparing to the state where the musical sounds are merely produced from the left/right speakers SP(L), SP(R), this example can improve the control of the front/backside sound broadened image.

As described heretofore, the first embodiment is designed to change the allocation manner of the musical tone waveform signals by use of the matrix controller MTR1, therefore, it is possible to change over the control manner of the sound images with ease.

(3) Modified Example

Figure 5:
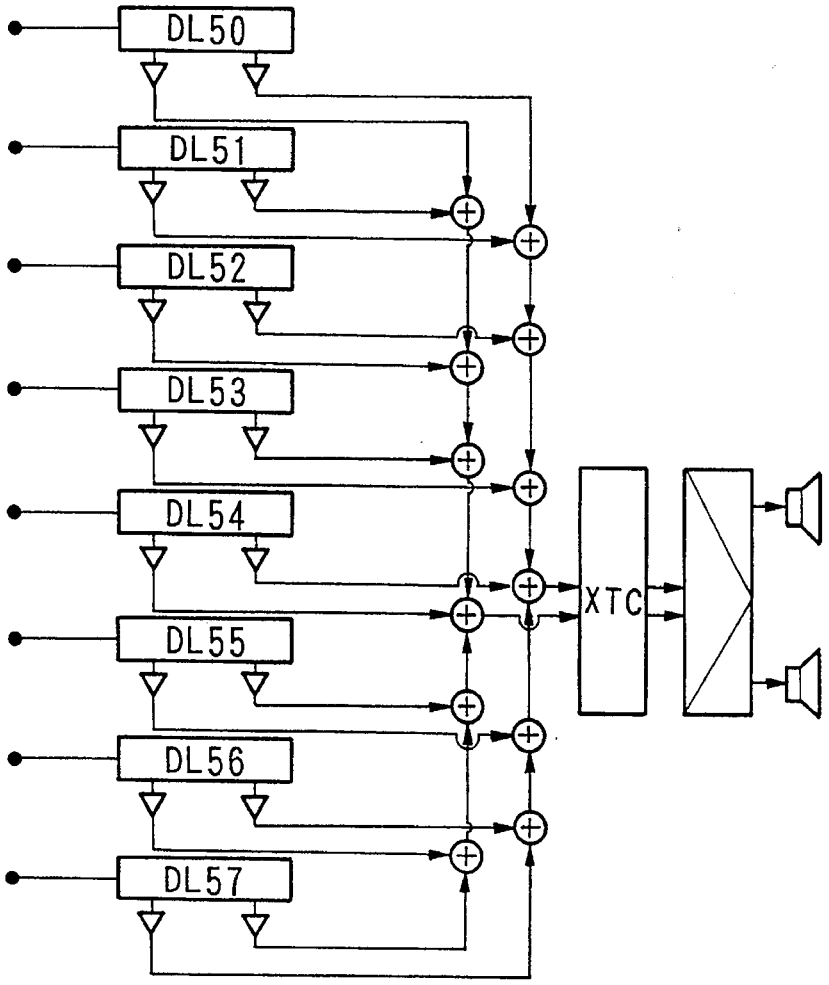
FIG. 5 is a block diagram showing a modified example of the first embodiment.

FIG. 5 is a block diagram showing a modified example of the foregoing first embodiment, in which there are provided eight delay circuits DL50–DL57 used for emerging the virtual speakers. In FIG. 5, the illustration is partially omitted, so that there are also provided eight adders, in the matrix controller MTR1, respectively corresponding to the above-mentioned eight delay circuits DL50–DL57. According to the configuration of this modified example, eight virtual speakers are emerged, so that the musical tone waveform signals can be adequately allocated to these virtual speakers. Due to the provision of eight virtual speakers, it is possible to perform the more precisely control on the sound-image positions.

[B] Second Embodiment

Next, description will be given with respect to the second embodiment of the present invention by referring to FIG. 6, wherein some parts corresponding to those of the foregoing first embodiment are omitted.

Figure 6:
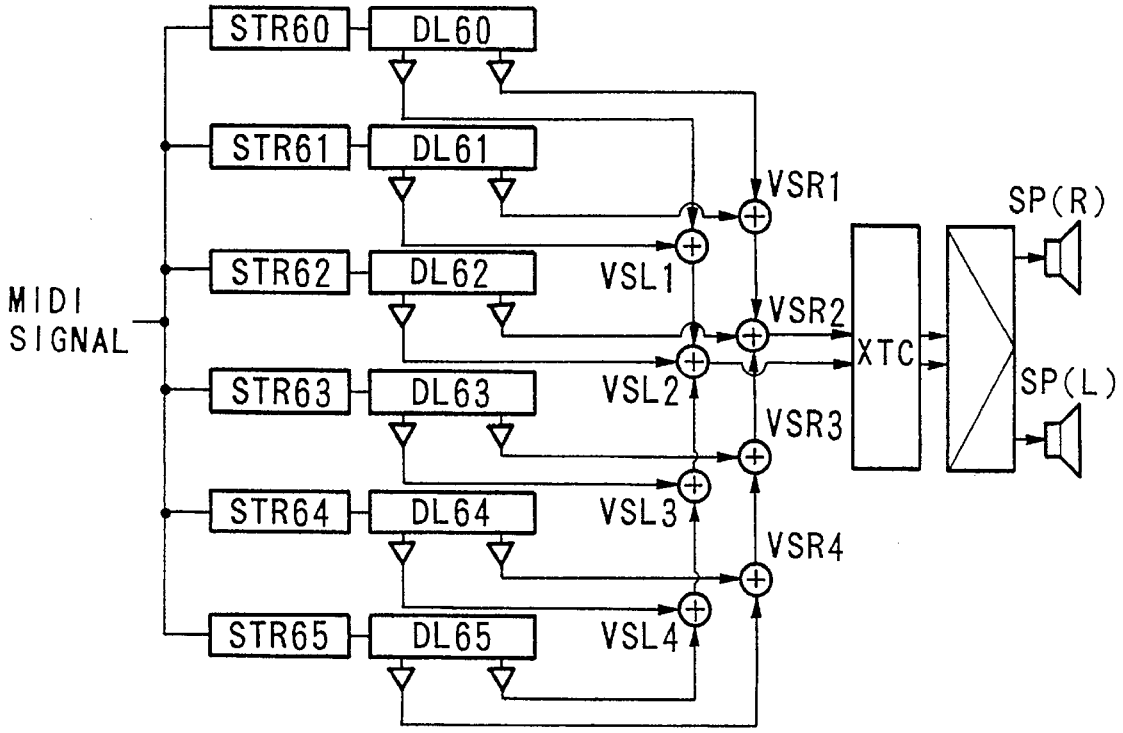
FIG. 6 is a block diagram showing an electronic configuration of a sound-image position control apparatus according to a second embodiment of the present invention.

In FIG. 6, numerals STR60–STR65 designate respective tone generators which are controlled by the MIDI signal (i.e., digital signal of which format is based on the standard for Musical Instruments Digital Interface). In short, one of the tone generators STR60–STR65 designated by the MIDI signal is activated to produce the musical tone waveform signal. The outputs of these tone generators STR60–STR65 are respectively supplied to the delay circuits DL60–DL65 which are used for forming the virtual speakers respectively. Then, the outputs of the delay circuits DL60–DL65 are multiplied by the predetermined coefficients respectively, so that some of the multiplied outputs are added together in adders VSR1–VSR4, VSL1–VSL4, of which addition results are supplied to the cross-talk canceler 2.

According to the configuration of the above-mentioned second embodiment, the output of each tone generator is produced as the musical sound from certain virtual speaker. Thus, when respectively connecting six strings of the guitar with six tone generators STR60–STR65, it is possible to well simulate the sound-producing manner of the guitar with respect to each string. The reason why such well simulation can be performed by the second embodiment is as follows:

When the guitar is located close to the listener so that the strings are also located close to the ears of the listener, the listener can clearly discriminate the separate sound produced from each string of the guitar. However, as the distance between the listener and guitar becomes larger, the sound-separation image of each string of the guitar becomes weaker. Therefore, in the end, the sounds produced from all strings of the guitar will be heard as one overall sounds which are produced from one sound-production point. Thus, by adequately setting the delay times of the delay circuits DL60–DL65 and the coefficients which are multiplied with the outputs of the delay circuits DL60–DL65, it is possible to offer the image of the distance by which the instrument is departed from the listener.

Figure 7:
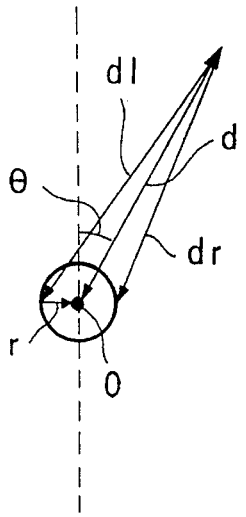
FIG. 7 is a drawing showing a relationship between the person and virtual sound source.

In the meantime, it is possible to compute the distance between the person and the virtual sound source which is embodied by the delay circuit as shown in FIG. 7. Herein, "r" designates a radius of the head of the person M; "d" designates a distance between the sound source and the center of head; and "θ" designates an angle which is formed between the sound source and the front-direction line of the head. In this case, it is possible to compute distances "dr" and "dl" by the following equations, wherein "dr" designates a distance between the sound source and the right ear of the person, while "dl" designates a distance between the sound source and the left ear of the person.

$$dr^2=r^2+d^2-2rd.\ \sin\theta\ \ldots \quad (1)$$

$$dl^2=r^2-d^2+2rd.\ \sin\theta\ \ldots \quad (2)$$

Thus, by computing these distances dr, dl with respect to each of the strings, it is possible to determine the factors for designing the delay circuits DL60–DL65 respectively.

Incidentally, in the aforementioned embodiments, it is possible for the user to arbitrarily set the connection pattern of the matrix controller MTR1 and the coefficient applied to each of the multipliers. Or, it is possible to store plural connection patterns and plural values for each coefficient in advance, so that the user can arbitrarily select one of them.

[C] Third Embodiment

Next, description will be given with respect to the third embodiment of the present invention, in which the sound-image position control apparatus 1 is applied to a game device 9, by referring to FIGS. 8 to 10.

Figure 8:
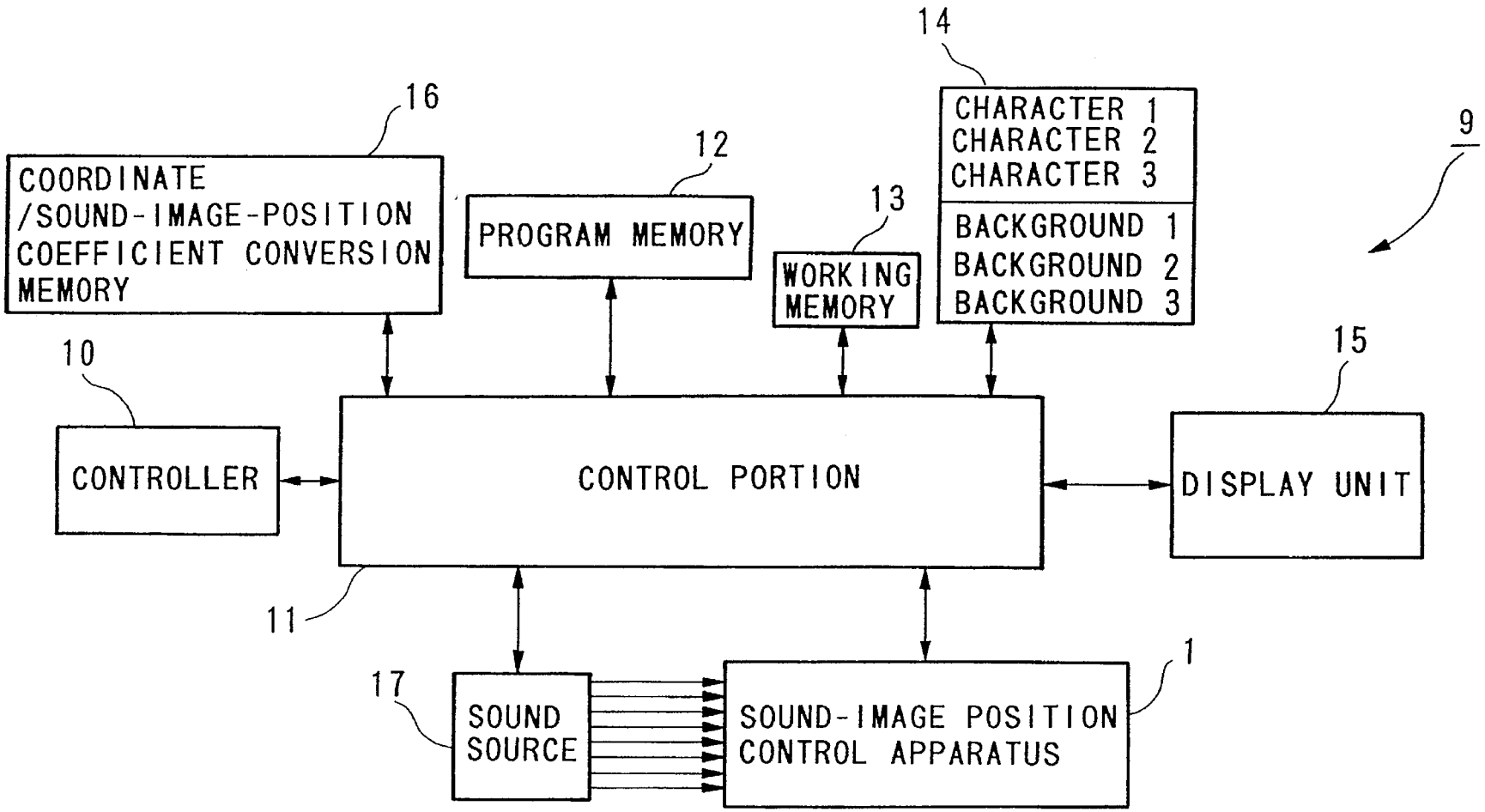
FIG. 8 is a block diagram showing an electronic configuration of a game device to which a sound-image position control apparatus according to a third embodiment of the present invention is applied.
Figure 9:
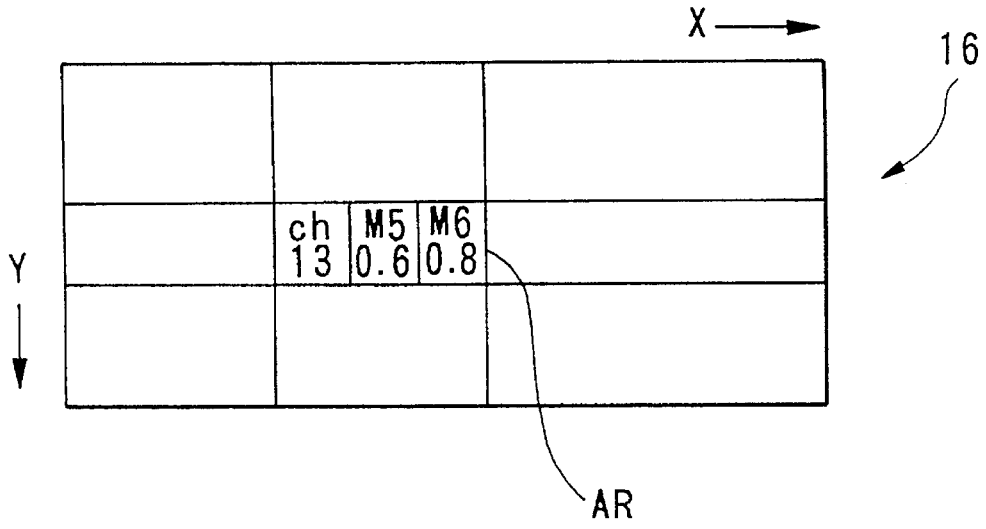
FIG. 9 is a drawing showing a two-dimensional memory map of a coordinate/sound-image-position coefficient conversion memory shown in FIG. 8.

FIG. 8 is a block diagram showing an electronic configuration of a game device 9. Herein, 10 designates a controller which controls the Joy-stick unit, tracking-ball unit and several kinds of push-button switches (not shown) so that the operating states of them are sent to a control portion 11. The control portion 11 contains a central processing unit (i.e., CPU) and several kinds of interface circuits, whereas it is designed to execute the predetermined game programs stored in a program memory 12. Thus, the game is in progress, while the overall control of the game device is performed by the control portion 11. In the progress of the game, a working memory 13 is collecting and storing several kinds of data which are obtained through the execution of the game programs. In response to the game program to be executed, a visual image information memory 14 stores visual image data to be displayed, representing the information of the visual images corresponding to character images C1, C2, C3 (given with the general numeral "C") and background images BG1, BG2, BG3 (given with the general numeral "BG"). These character images may correspond to the visual images of person, automobile, air plane, animal, or other kinds of objects. The above-mentioned visual image data are read out in the progress of the game, so that the corresponding visual image is displayed at the predetermined position of a display screen of a display unit 15 by the predetermined display size in response to the progress of the game.

Next, a coordinate/sound-image-position coefficient conversion memory 16 stores parameters by which the display position of the character C in the display unit 15 is located at the proper position corresponding to the sound-image position in the two-dimensional area. FIG. 9 shows a memory configuration of the above-mentioned coordinate/sound-image-position coefficient conversion memory 16. FIG. 10 shows a position relationship between a player P of the game and the game device 9 in the two-dimensional area. The X-Y coordinates of the coordinate/sound-image-position coefficient conversion memory 16 as shown in FIG. 9 may correspond to the X-Y coordinates of the display screen of the display unit 15. In FIG. 9, the output channel number CH of a sound source 17 and some of the coefficients CM1–CM12 which are used by the multipliers M1–M12 in the sound-image position control apparatus 1 are stored at the memory area designated by the X-, Y-coordinate values which indicates the display position of the character C in the display unit 15. For example, at an area designated by "AR", a value "13" is stored as the output channel number, while the other values "0.6" and "0.8" are also stored as the coefficients CM5, CM6 used for the multipliers M8, M6 respectively.

Figure 10:
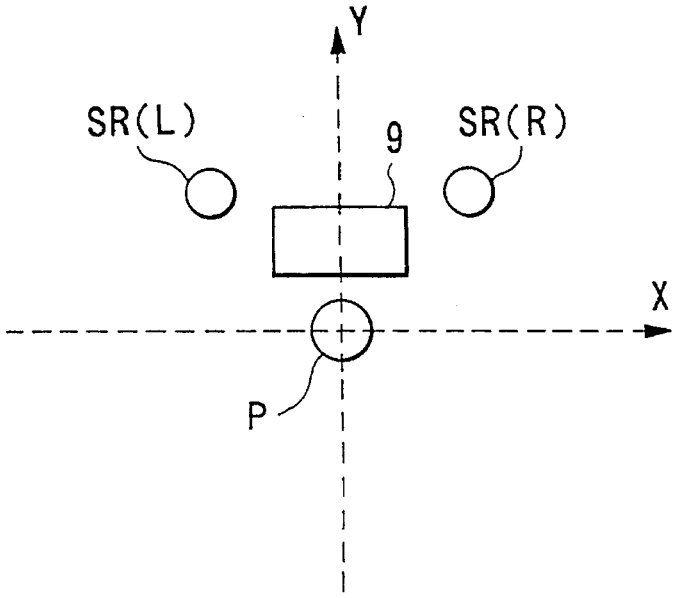
FIG. 10 is a plan view illustrating a position relationship between the player and game device.

The X/Y coordinates of the coordinate/sound-image-position coefficient conversion memory 16 are set corresponding to those of the-actual two-dimensional area shown in FIG. 10. In other words, the display position of the character C in the display unit 15 corresponds to the actual two-dimensional position of the player as shown in FIG. 10. Thus, by adequately setting the parameters, the sounds will be produced from the actual position corresponding to the display position of the character C. Incidentally, the memory area of the coordinate/sound-image-position coefficient conversion memory 16 is set larger than the display area of the display unit 15. In this case, the proper channel number CH and some of the coefficients CM1–CM12 are memorized such that even if the character C is located at the coordinates of which position cannot be displayed by the display unit 15, the sounds are produced from the actual position corresponding to the coordinates of the character C. Moreover, the display position of the character C is controlled to be automatically changed in response to the progress of the game on the basis of the game programs stored in the program memory 12, or it is controlled to be changed in response to the manual operation applied to the controller 10.

Next, the sound source 17 has plural channels, used for the generation of the sounds, which are respectively operated in a time-division manner. Thus, in response to the instruction given from the control portion 11, each channel produces a musical tone waveform signal. Such musical tone waveform signal is delivered to the predetermined one or some of eight channels Ch10–Ch17 of the sound-image position control apparatus 1. Particularly, the musical tone waveform signal regarding to the character C is delivered to certain channel Ch which is designated by the foregoing output channel number CH. As described before, this sound-image position control apparatus 1 has the electronic configuration as shown in FIG. 1(A), wherein the predetermined coefficients CM1–CM12 are respectively applied to the multipliers M1–M12 so as to control the sound-image position of each channel Ch when producing the sounds from the speakers SP(L), SP(R).

According to the electronic configurations as described heretofore, when the power is applied to the game device 9, the control portion 11 is activated to execute the programs stored in the program memory 12 so as to progress the game. In response to the progress of the game, one of the background images BG1, BG2, BG3 is selectively read from the visual image information memory 14 so that the selected background image is displayed on the display screen of the display unit 15. Similarly, one of the character images C1, C2, C3 is selectively read out so that the selected character image is displayed in the display unit 15. Meanwhile, the control portion 11 gives an instruction to the sound source 17 so as to produce the musical tone waveform signals corresponding to the background music in response to the progress of the game. In addition, the control portion 11 also instructs the sound source 17 to produce the other musical tone waveform signals having the musical tone characteristics (such as the tone color, tone pitch, sound effects, etc.) corresponding to the character C. Moreover, the control portion 11 reads out the output channel number CH and coefficient CM (i.e., one or some of CM1–CM12) from the memory area of the coordinate/sound-image-position coefficient conversion memory 16 corresponding to the display position of the character C in the display unit 15, and then the read data are supplied to the sound source 17 and sound-image position control apparatus 1 respectively. In this case, the sound source 17 produces the musical tone waveform signal corresponding to the character C, and this musical tone waveform signal is outputted to the sound-image position control apparatus 1 from the channel Ch which is designated by the output channel number CH. The other musical tone waveform signals are also outputted to the sound-image position control apparatus 1 from the corresponding channels respectively. In the sound-image position control apparatus 1, each of the coefficients CM read from the coordinate/sound-image-position coefficient conversion memory 16 is supplied to each of the multipliers M1–M12. Thus, the sound-image position of each channel is controlled to be fixed responsive to the coefficient CM, and consequently, the musical sounds are produced from the speakers SP(L), SP(R) at the fixed sound-image positions.

When the player P intentionally operates the controller 10 to move the character C, the control portion 11 is operated so that the display position of the character C displayed in the display unit 15 is moved by the distance corresponding to the manual operation applied to the controller 10. In this case, new output channel number CH and coefficient CM are read from the memory area of the coordinate/sound-image-position coefficient conversion memory 16 corresponding to the new display position of the character C, and consequently, these data are supplied to the sound source 17 and sound-image position control apparatus 1 respectively. Thus, the actual sound-image position is also moved responsive to the movement of the character C.

According to the present embodiment, when the character C representing the visual image of the air plane is located outside of the display area of the display unit 15 and such character C is moved closer to the player P from his back, the character C is not actually displayed on the display screen of the display unit 15. However, since the foregoing coordinate/sound-image-position coefficient conversion memory 16 has the memory area which is larger than the display area of the display unit 15, the sounds corresponding to the character C are actually produced such that the sounds are coming closer to the player P from his back. As a result, the player P can recognize the existence and movement of the air plane of which visual image is not actually displayed. This can offer a brand-new live-audio effect which cannot be obtained from the conventional game device system.

Incidentally, the present embodiment is designed to manage the movement of the character C in the two-dimensional coordinate system. Of course, the present invention is not limited to it, so that the present embodiment can be modified to manage the movement of the character C in the three-dimensional coordinate system. In such modification, number of the actual speakers are increased, and they are arranged in the three-dimensional space.

In the present embodiment, the X/Y coordinates of the display unit 15 are set corresponding to those of the actual two-dimensional area. However, this embodiment can also modified to simulate the game of the automobile race. In this case, only the character C which is displayed in front of the player P is displayed in the display unit 15 by matching the visual range of the player P with the display area of the display unit 15.

[D] Fourth Embodiment

Next, the description will be given with respect to the fourth embodiment of the present invention, wherein the sound-image position control apparatus is modified to be applied to the movie system, video game device (or television game device) or so-called CD-I system in which the sound-image position is controlled responsive to the video image.

Figure 11:
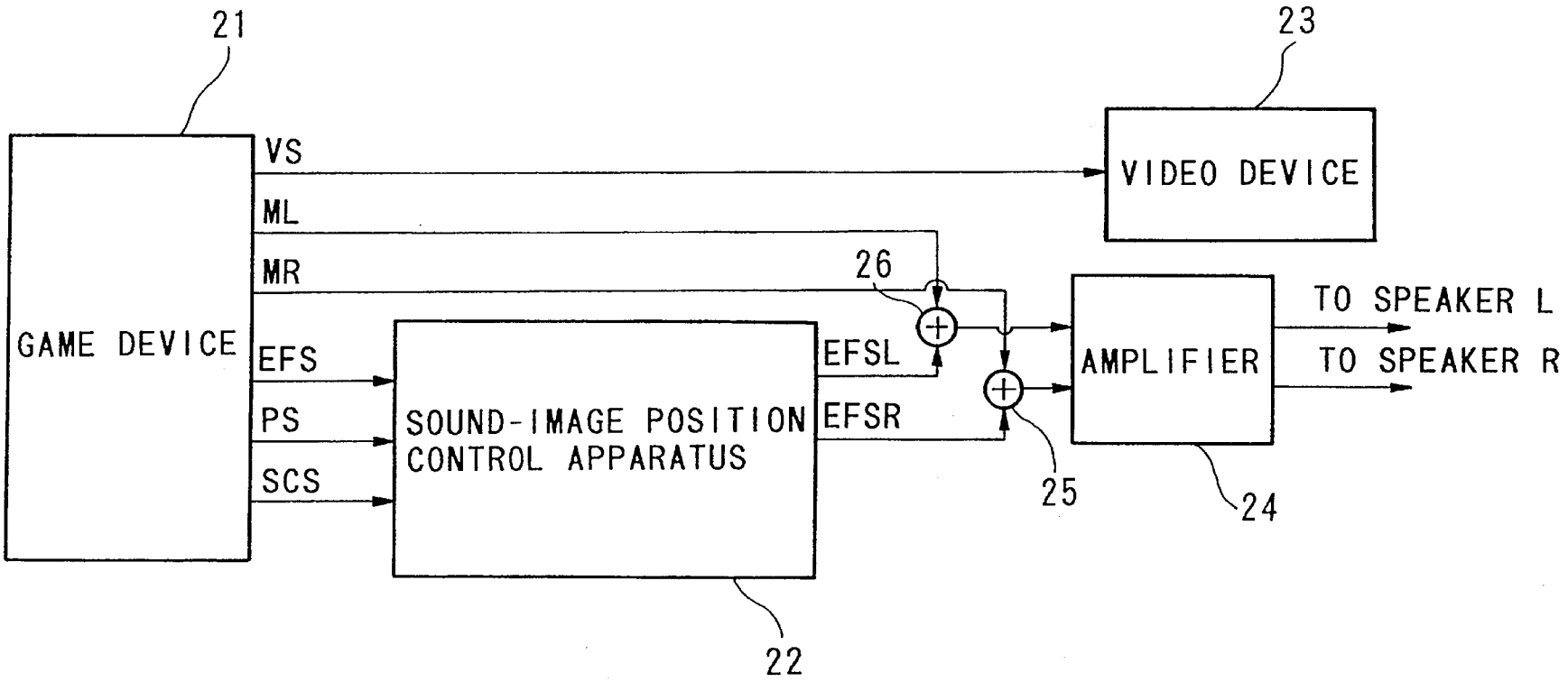
FIG. 11 is a block diagram showing an electronic configuration of a video game system.

Before describing the fourth embodiment in detail in conjunction with FIGS. 11 to 13, the description will be given with respect to the background of the fourth embodiment by referring to FIGS. 14 and 15.

First of all, the so-called binaural technique is known as the technique which controls and fixes the sound-image position in the three-dimensional space. According to the known technique, the sounds are recorded by use of the microphones which are located within the cars of the foregoing dummy head, so that the recorded sounds are reproduced by use of the headphone set so as to recognize the sound-image position which is fixed at the predetermined position in the three-dimensional space. Recently, some attempts are made to simulate the tone area which is formed in accordance with the shape of the dummy head. In other words, by simulating the transfer function of the sounds which are transmitted in the three-dimensional space by use of the digital signal processing technique, the sound-image position is controlled to be fixed in the three-dimensional space.

Figure 14:
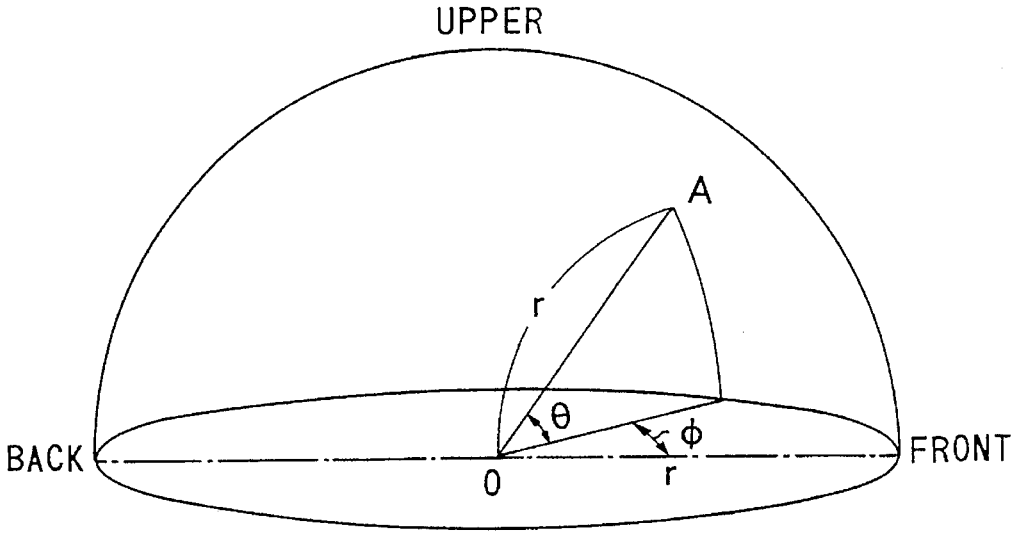
FIG. 14 illustrates a polar-coordinate system which is used for defining a three-dimensional space.

The coordinate system of the above-mentioned three dimensional space can be defined by use of the illustration of FIG. 14. In FIG. 14, "r" designates a distance from the origin "0"; $\phi$ designates an azimuth angle with respect to the horizontal direction which starts from the origin "0"; $\theta$ designates an elevation angle with respect to the horizontal area containing the origin "0", thus, the three-dimensional space can be defined by the polar coordinates in the space. When locating the listener or dummy head at the origin 0, its front direction can be defined as $\phi=0$, whereas its left-side direction is defined by $\phi>0$ and its right-side direction is defined by $\phi<0$. In addition, the upper direction is defined by $\theta>0$.

As a model which controls and fixes the sound-image position in the three-dimensional space by use of the digital signal processing technique, the dummy head is located at the origin 0 and then the impulse signal is produced from the predetermined point A, for example. Then, the responding sounds corresponding to the impulse signal are sensed by the microphones which are respectively located within the ears of the dummy head. These sensed sounds are converted into the digital signals which are recorded by some recording medium. These digital signals represent two impulse-response data respectively corresponding to the sounds picked up by the left-side and right-side ears of the dummy head. These two impulse-response data are converted into the coefficients, which can be supplied to by which two finite-impulse response digital filters (hereinafter, simply referred to as FIR filters) are respectively given. In this case, the audio signal of which sound-image position is not fixed is delivered to two FIR filters, through which two digital outputs are obtained as the left/right audio signals. These left/right audio signals are applied to left/right inputs of the headphone set, so that the listener can hear the stereophonic sounds from this headphone set as if those sounds are produced from the point A. By changing this point A and measuring the impulse response, it is possible to obtain the other coefficients for the FIR filters. In other words, by locating the point A at the desirable position, it is possible to obtain the coefficients for the FIR filters, by which the sound-image position can be fixed at the desirable position. The above-mentioned technique offers an effect by which the three-dimensional sound-image position is determined by use of the sound-reproduction system of the headphone set. The same effect can be embodied by use of the so-called two-speaker sound-reproduction system in which two speakers are located at the predetermined front positions of the listener, which is called a cross-talk canceling technique.

According to the cross-talk canceling technique, the sounds are reproduced as if they are produced from certain position (i.e., position of the foregoing virtual speaker) at which the actual speaker is not located. Herein, two FIR filters are required when locating one virtual speaker, hereinafter, a set of two FIR filters will be called as a sound-directional device.

Figure 15:
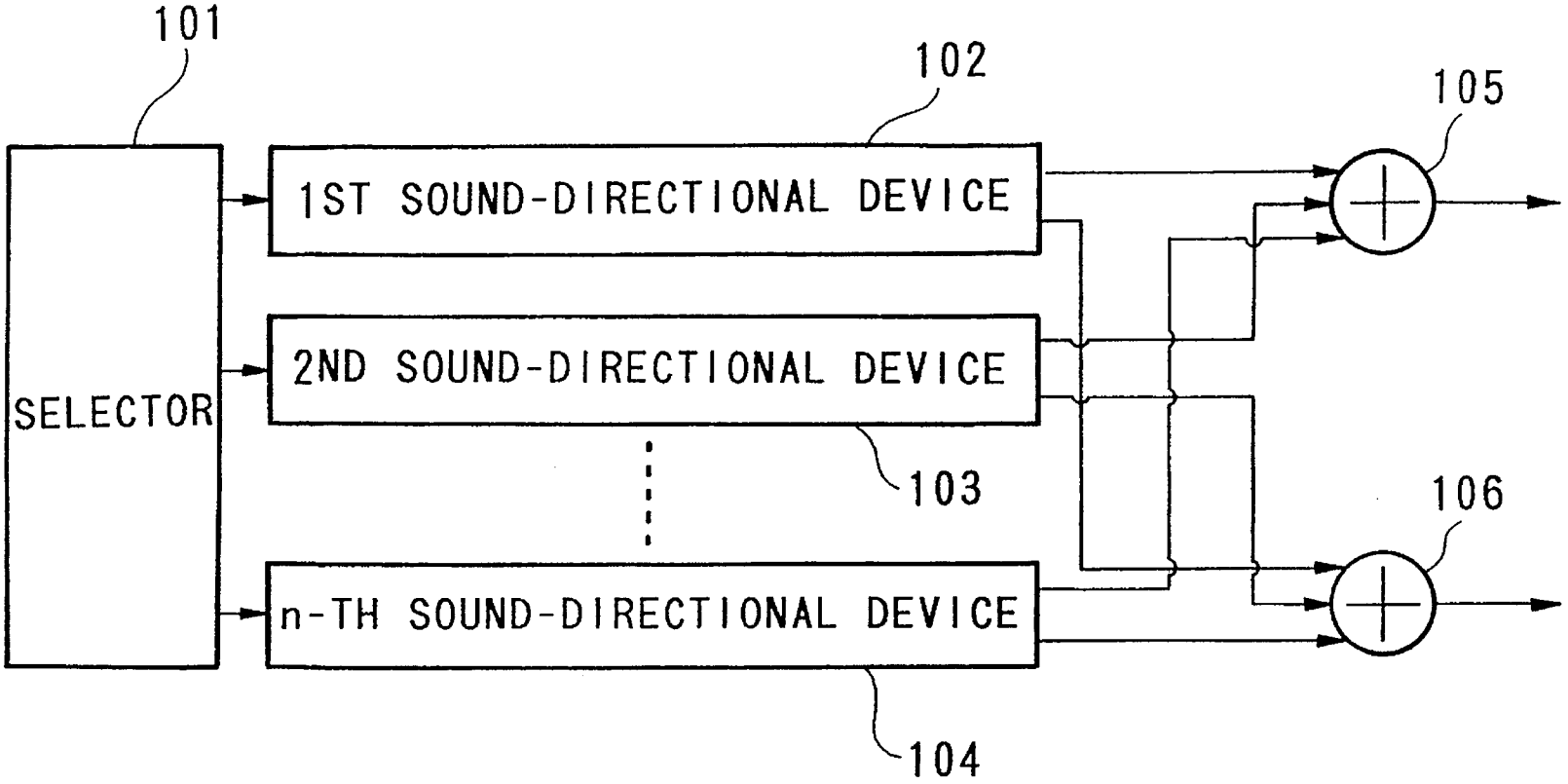
FIG. 15 is a block diagram showing a typical example of a virtual-speaker system, of which concept is applied to the fourth embodiment.

FIG. 15 is a block diagram showing an example of the virtual-speaker circuitry which employs the above-mentioned sound-directional device. In FIG. 15, 102–104 designate sound-directional devices, each of which contains two FIR filters. This drawing only illustrates three sound-directional devices 102–104, however, there are actually provided several hundreds of the sound-directional devices. Thus, it is possible to locate hundreds of virtual speakers in a close-tight manner with respect to all of the directions of the polar-coordinate system. These virtual speakers are not merely arranged along with a spherical surface with respect to the same distance r, but they are also arranged in a perspective manner with respect to different distances r. A selector 101 selectively delivers the input signal to one of the sound-directional devices such that the sounds will be produced from the predetermined one of the virtual speakers, thus controlling and fixing the sound-image position in the three-dimensional space. Incidentally, adders 105, 106 output their addition results as the left/right audio outputs respectively.

The above-mentioned example can be modified such that one sound-directional device is not fixed corresponding to one direction of producing the sound. In other words, by changing the coefficients of the FIR filters contained in one sound-directional device, it is possible to move the sound-image position by use of only one sound-directional device.

In the meantime, some movie theater employs so-called surround acoustic technique which uses four or more speakers. Therefore, the sounds are produced from one or some speakers in response to the video image.

When embodying such surround acoustic technique by use of the former virtual-speaker system providing hundreds of sound-directional devices, it is necessary to provide hundreds of FIR filters, which enlarges the scale of the system so that the cost of the system will be eventually raised up. Even in the case of the latter system which provides only one sound-directional device, it is necessary to provide hundreds of coefficients used for the FIR filter, which is not realistic. Because, it Is very difficult to control or change so many number of coefficients in a real-time manner. Further, when embodying the foregoing surround acoustic technique in the movie theater, it is necessary to provide a plenty of amplifiers and speakers, which eventually raises the cost of the facilities.

(a) Configuration of Fourth Embodiment

Next, the detailed description will be given with respect to the fourth embodiment of the present invention. FIG. 11 is a block diagram showing the whole configuration of the video game system. Herein, a game device 21 is designed to produce a video signal VS, a left-side musical tone signal ML, a right-side musical tone signal MR, a sound effect signal EFS, a panning signal PS and a scene-identification signal SCS. When receiving the sound effect signal EFS, panning signal PS and scene-identification signal SCS, a sound-image position control apparatus 22 imparts the fixed sound image to the sound effect signal EFS, thus producing two signals EFSL, EFSR. Then, an adder 25 adds the signals EFSR and MR together, while an adder 26 adds the signals EFSL and ML together. The results of the additions respectively performed by the adders 25, 26 are supplied to an amplifier 24. The amplifier 24 amplifies these signals so as to respectively output the amplified signals to left/right loud-speakers (represented by 43, 44 in FIG. 13). In the meantime, the video signal VS is supplied to a video device 23, so that the video image is displayed for the person.

The game device 21 is configured as the known video game device which is designed such that responsive to the manipulation of the player of the game, the scene displayed responsive to the video signal VS is changed or the position of the character image is moved. During the game, the musical tone signals ML, MR are outputted so as to playback the background music. In addition, to this background music, the other sounds are also produced. For example, the sounds corresponding to the character image which is moved responsive to the manipulation of the player, or the other sounds corresponding to the other character images which are automatically moved under control of the control unit built in the game device 21 are produced by the sound effect signal EFS. In case of the game of the automobile race, the engine sounds of the automobiles are automatically produced.

The scene-identification signal SCS is used for determining the position of the virtual speaker in accordance with the scene. Every time the scene is changed, this scene-identification signal SCS is produced as the information representing the changed scene. Such scene-identification signal SCS is stored in advance within a memory unit (not shown) which is built in the game device 21. More specifically, this signal is stored at the predetermined area adjacent to the area storing the data representing the background image with respect to each scene of the game. Thus, when the scene is changed, this signal is simultaneously read out.

On the other hand, the panning signal PS represents certain position which is located between two virtual speakers. By varying the value of this panning signal PS between "0" and "1", it is possible to freely change the sound-image position corresponding to the sound produced responsive to the sound effect signal EFS between two virtual speakers. In the present embodiment, the programs of the game contain the operation routine for the panning signal PS, by which the panning signal PS is computed on the basis of the scene-identification signal SCS and the displayed position of the character image corresponding to the sound effect signal EFS. Of course, such computation of the panning signal PS can be omitted, so that in response to the position of the character, the game device 21 automatically reads out the panning signal PS which is stored in advance in the memory unit. Incidentally, the present embodiment is designed such that two virtual speakers are emerged, which will be described later in detail.

Figure 12:
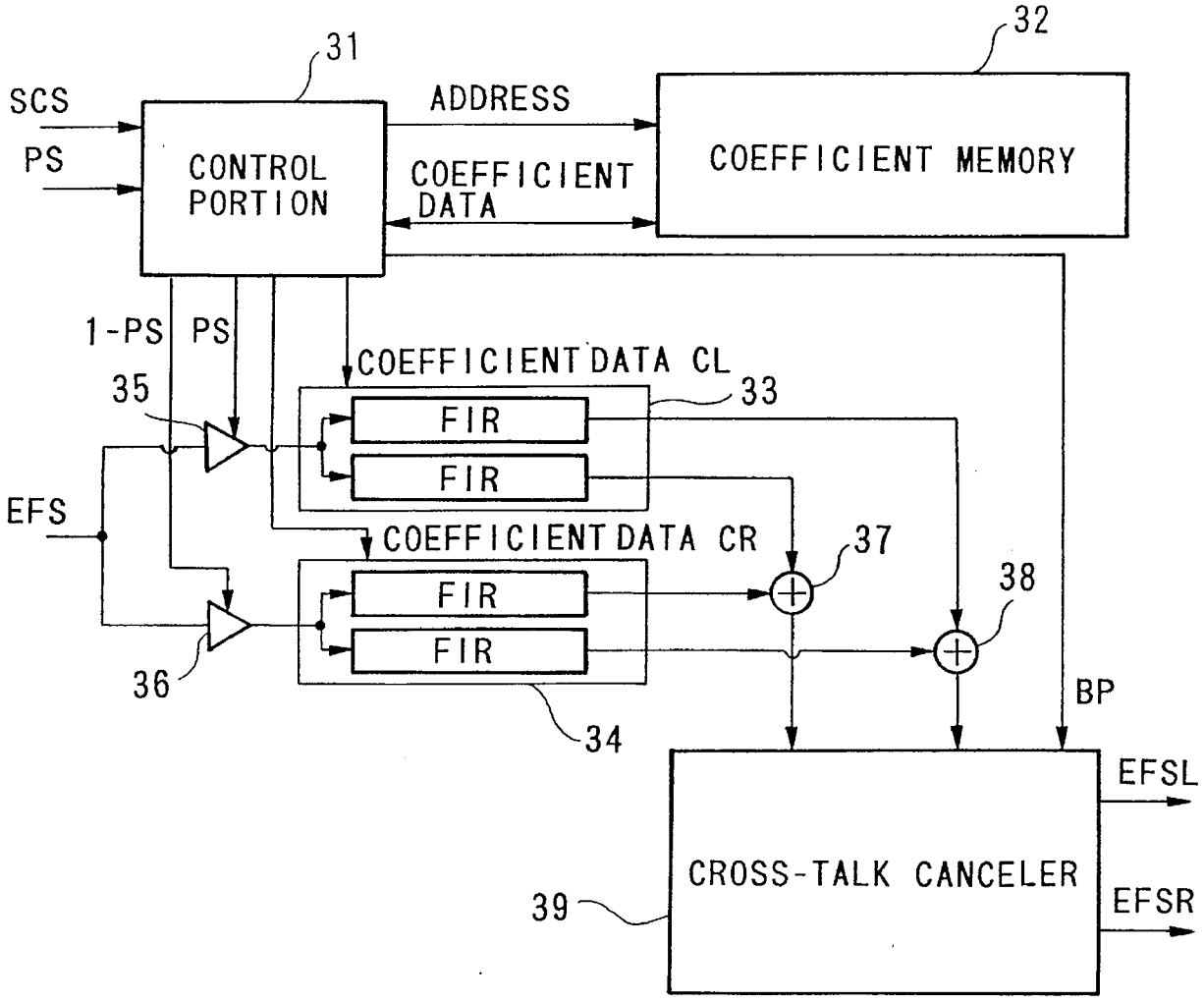
FIG. 12 is a block diagram showing an electronic configuration of a sound-image position control apparatus, shown in FIG. 11, according to a fourth embodiment of the present invention.
Figure 13:
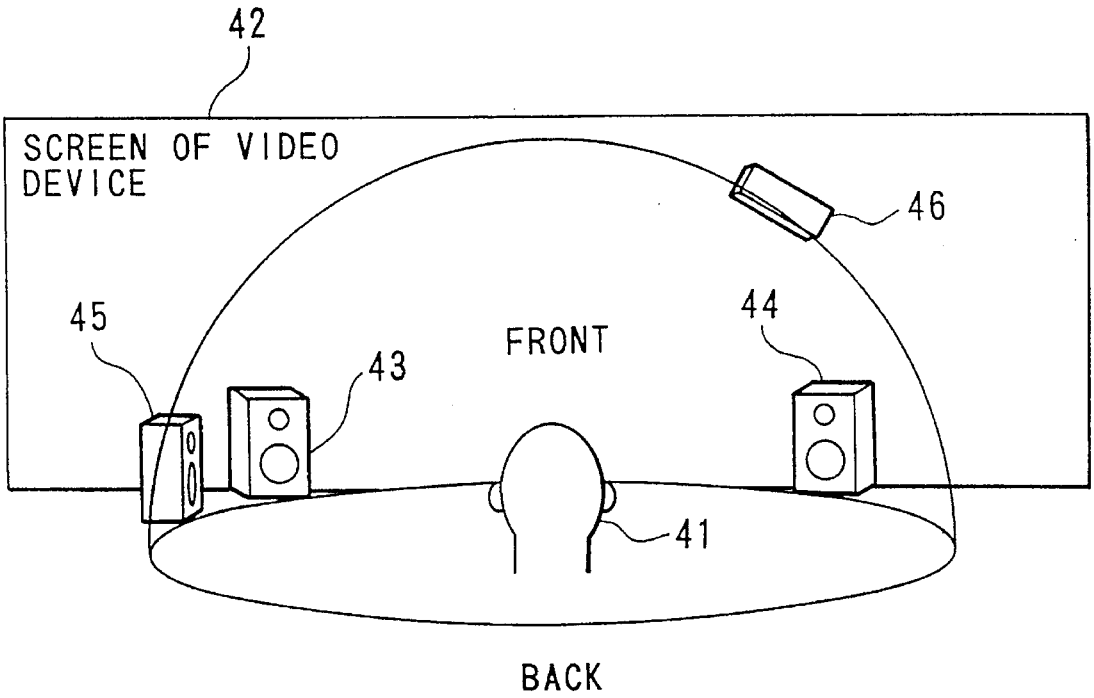
FIG. 13 is a drawing illustrating a position relationship among a listener, loud-speakers and a video screen.

FIG. 12 is a block diagram showing an internal configuration of the sound-image position control apparatus 22. Herein, a control portion 31 is configured as the central processing unit (i.e., CPU), which performs the overall control on this apparatus 22. This control portion 31 receives the foregoing scene-identification signal SCS and panning signal PS. A coefficient memory 32 stores the coefficients of the FIR filters. As described before, the impulse response is measured with respect to the virtual speaker which is located at the desirable position, so that the above-mentioned coefficients are determined on the basis of the result of the measurement. In order to locate the virtual speaker at the optimum position corresponding to the scene of the game, the coefficients for the FIR filters are computed in advance with respect to several positions of the virtual speaker, and consequently, these coefficients are stored at the addresses of the memory unit corresponding to the scene-identification signal SCS. As described before, each of sound-directional devices 33, 34 is configured by two FIR filters. The coefficient applied to the FIR filter can be changed by the coefficient data given from the control portion 31.

In response to the scene-identification signal SCS, the control portion 11 reads out the coefficient data, respectively corresponding to the virtual speakers L, R, from the coefficient memory 32, and consequently, the read coefficient data are respectively supplied to the sound-directional devices 33, 34. When receiving the coefficients, each of the sound-directional devices 33, 34 performs the predetermined signal processing on the input signal of the FIR filters, thus locating the virtual speaker at the optimum position corresponding to the scene-identification signal SCS.

The sound effect signal EFS is allocated to the sound-directional devices 33, 34 via multipliers 35, 36 respectively. These multipliers 35, 36 also receive the multiplication coefficients respectively corresponding to the values "PS", "1-PS" from the control portion. Herein, the value "PS" represents the value of the panning signal PS, while the value "1-PS" represents the one's complement of the panning signal PS. The outputs of first FIR filters in the sound-directional devices 33, 34 are added together by an adder 37, while the other outputs of second FIR filters in the sound-directional devices 33, 34 are added together by another adder 38. Therefore, these adders 37, 38 output their addition results as signals for the speakers 43, 44 respectively. These signals are supplied to a cross-talk canceler 39.

The cross-talk canceler 39 is provided to cancel the cross-talk component included in the sounds. For example, the cross-talk phenomenon must be occurred when producing the sounds from the speakers 43, 44 in FIG. 13. Due to this cross-talk phenomenon, the sound component produced from the left-side speaker affects the sound which is produced from the right-side speaker for the right ear of the listener, while the sound component produced from the right-side speaker affects the sound which is produced from the left-side speaker for the left ear of the listener. Thus, in order to cancel the above-mentioned cross-talk components, the cross-talk canceler 39 performs the convolution process by use of the phase-inverted signal having the phase which is inverse to that of the cross-talk component. Under operation of this cross-talk canceler 39, the outputs of the sound-directional device 33 are converted into the sounds which are roughly heard by the left ear only from the left-side speaker, while the outputs of the sound-directional device 34 are converted into the sounds which are roughly heard by the right ear only from the right-side speaker. Such sound allocation can roughly embody the situation in which the listener hears the sounds by use of the headphone set.

Meanwhile, the cross-talk canceler 39 receives a cross-talk bypass signal BP from the control portion 31. This cross-talk bypass signal BP is automatically produced by the control portion 31 when inserting the headphone plug into the headphone jack (not shown). When the headphone plug is not inserted, the cross-talk bypass signal BP is turned off, so that the sounds are reproduced from two speakers while canceling the cross-talk components as described before. On the other hand, when the headphone plug is inserted, the cross-talk canceling operation is omitted, so that the signals are supplied to the headphone set from which the sounds are reproduced.

Next, the description will be given with respect to the method how to control and fix the sound-image position by the panning signal PS. When the value of the panning signal PS is equal to zero, the foregoing sound effect signal EFS is supplied to the sound-directional device 34 only. Thus, the sound-image position is fixed at the position of the virtual speaker (i.e., position of the speaker 45 in FIG. 13) which is located by the sound-directional device 34. On the other hand, when the value of the panning signal PS is at "1", the sound effect signal EFS is supplied to the sound-directional device 33 only, and consequently, the sound-image position is fixed at the position of the virtual speaker (i.e., position of a speaker 46) which is located by the sound-directional device 33. When the value of the panning signal PS is set at a point between "0" and "1", the sound-image position is fixed at an interior-division point corresponding to the panning signal PS between the virtual speakers 45, 46.

(b) Operation of Fourth Embodiment

Next, description will be given with respect to the operation of the fourth embodiment by referring to FIG. 13. In FIG. 13, a player 41 is positioned at the center, whereas the left-side speaker 43 is located at the left/front-side position from the player 41 which is defined by $\phi=45°$, $\theta=0°$, $r=1.5$ m. while the right-side speaker 44 is located at the right/front-side position from the player 41 which is defined by $\phi=-45°$, $\theta=0°$, $r=1.5$ m. In front of the player 41, there is located a display screen 42 of the video device 23. In the present embodiment, this display screen 42 has a flat-plate-like shape, however, it is possible to form this screen by the curved surface which surrounds the player 41.

For example, the player 41 plays the game and the duel scene of the Western is displayed. In this case, the game device 21 outputs the scene-identification signal SCS to the control portion 31 in the sound-image position control apparatus 22, wherein this scene-identification signal SCS has the predetermined scene-identifying value, e.g., four-bit data "0111". Then, the control portion 31 reads out coefficient data CL, corresponding to the scene-identification signal SCS, from the coefficient memory 32, wherein this coefficient data CL represents the coefficient for the FIR filter which corresponds to the position of the left-side virtual speaker 45 (defined by $\phi=85°$, $\theta=0°$, $r=3.5$ m). This coefficient data CL is supplied to the sound-directional device 33. In addition, the control portion 31 also read out another coefficient data CR representing the coefficient for the FIR filter which corresponds to the position of the right/upper-side virtual speaker 46 (defined by $\phi=-40°$, $\theta=65°$, $r=15.0$ m). This coefficient data CR is supplied to the sound-directional device 34. Thus, the virtual speakers 45, 46 are located at their respective positions as shown in FIG. 13.

The game device 21 produces the musical tone signals ML, MR which are sent to the speakers 43, 44 via the adders 25, 26 and amplifier 24, whereas the music which is suitable for the duel scene is reproduced, while the other background sounds such as the wind sounds are also reproduced, regardless of the sound-image position control. In response to a shot action of a gunfighter which is the displayed image and plays an enemy role for the player 41 in the gunfight game, the sound effect signal EFS representing a gunshot sound is supplied to the sound-image position control apparatus 22. In this case, if the value of the panning signal PS is equal to zero, the gunshot is merely sounded from the position of the virtual speaker R46. Such sound effect corresponds to the scene in which the gunfighter shoots a gun by aiming at the player 41 from the second floor of the saloon. On the other hand, if the value of the panning signal PS is equal to "1", the gunshot may be sounded in the scene in which the gunfighter is placed at the left-side position very close to the player 41 and then the gunfighter shoots a gun at the player 41. If the value of the panning signal PS is set at certain value between "0" and "1", the gunfighter is placed at certain interior-division point on the line connected between the virtual speakers 45, 46, and then the gunshot is sounded.

The game device 21 is designed such that even in the same duel scene of the Western, every time the position of the enemy is changed, new scene-identification signal SCS (having a new binary value such as "1010") is produced and outputted to the sound-image position control apparatus 22. In other words, the change of the position of the enemy is dealt as the change of the scene. Thus, the virtual speakers will be located again in response to the new scene.

Other than the above-mentioned Western game, the game device 21 can also play the automobile race game. Herein, the game device 21 outputs a new scene-identification signal SCS (having a binary value such as "0010"), by which the control portion 31 reads out two coefficient data respectively corresponding to the right/front-side virtual speaker and right/back-side virtual speaker. These coefficient data are respectively supplied to the sound-directional devices 33, 34. In this case, the foregoing signals ML, MR represent the background music and the engine sounds of the automobile to be driven by the player 41. Further, the foregoing signal EFS represents the engine sounds of the other automobiles which will be running in the race field as the displayed images. On the basis of the foregoing operation routine, the panning signal PS is computed and renewed in response to the position relationship between the player's automobile and the other automobiles. If another automobile is running faster than the player's automobile so that another automobile will get ahead of the player's automobile, the value of the panning signal PS is controlled to be gradually increased from "0" to "1". Thus, in response to the scene in which another automobile gets ahead of the player's automobile, the sound-image position of the engine sound of another automobile is controlled to be gradually moved ahead.

As described above, the fourth embodiment is applied to the game device. However, it is possible to modify the present embodiment such that the sound-image position control is performed in response to the video scene played by the video disk player. Or, it is possible to apply the present embodiment to the CD-I system. In this case, the foregoing scene-identification signal SCS and panning signal PS can be recorded at the sub-code track provided for the audio signal.

Further, the present embodiment uses two sound-directional devices, however, it is possible to modify the present embodiment such that three or four sound-directional devices are provided to cope with more complicated video scenes. In this case, the complicated control must be performed on the panning signal PS. However, it is not necessary to provide hundreds of sound-directional devices, or it is not necessary to simultaneously change hundreds of coefficients for the FIR filters.

Moreover, the sound-directional device of the present embodiment is configured by the FIR filters, however, this device can be configured by the infinite-impulse response digital filters (i.e., IIR filters). For example, the so-called notch filter is useful when fixing the sound-image position with respect to the elevation-angle direction. Further, it is also known that the band-pass filter controlling the specific frequency-band is useful when controlling the sound-image position with respect to the front/back direction. When embodying such filter by use of the IIR filters, the fixing degree of the sound-image position may be reduced as compared to the FIR filters. However, the IIR filter has a simple configuration as compared to the FIR filter, so that the number of the coefficients can be reduced. In short, the IIR filter is advantageous in that the controlling can be made easily.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A sound image position control apparatus comprising:

a first signal generation means for generating a first signal;

a second signal generation means for generating a second signal, wherein the second signal is distinct from the first signal;

a first virtual speaker positioning means for defining a position of a first virtual speaker with respect to an actual speaker position;

a second virtual speaker positioning means for defining a position of a second virtual speaker with respect to an actual speaker position, the first and said second virtual speaker positioning means causing the first and second virtual speakers to be positioned so as to define a sound field enlarged with respect to a sound field defined by the actual speaker positions;

a first mixing means for coupling a portion of the output from the first signal generation means and a portion of the output from the second signal generation means to the first virtual speaker positioning means in accordance with a first mixing ratio;

a second mixing means for coupling a portion of the output from the first signal generation means and a portion of the output from the second signal generation means to the second virtual speaker positioning means in accordance with a second mixing ratio:

a third mixing means for mixing a first output signal output by the first virtual speaker positioning means with a first output signal output by the second virtual speaker positioning means; and a fourth mixing means for mixing a second output signal output by the first virtual speaker positioning means with a second output signal output by the second virtual speaker positioning means, wherein a position of a generated audio signal is localized away from the first and second virtual speaker positions in accordance with the first and second mixing ratios.

2. The sound image position control apparatus of claim 1, wherein the first signal generation means and the second signal generation means correspond to circuits that generate different musical tone waveforms corresponding to a musical instrument.

3. The sound image position control apparatus of claim 1, wherein the first virtual speaker positioning means comprises a delay circuit.

4. The sound image position control apparatus of claim 1, wherein the first signal generation means comprises a tone generator controlled by a MIDI signal.

5. The sound image position control apparatus of claim 1, wherein the first and second signal mixing means are part of a matrix controller containing plural multipliers and plural adders in which a connection pattern is changed to accommodate a change in a signal mixing protocol.

6. A sound image position control apparatus comprising:

a first signal generation means for generating a signal corresponding to a first predetermined audio frequency range;

a second signal generation means for generating a signal corresponding to a second predetermined audio frequency range, wherein the second predetermined audio frequency range is distinct from the first predetermined audio frequency range;

a first virtual speaker positioning means for defining a position of a first virtual speaker with respect to an actual speaker position;

a second virtual speaker positioning means for defining a position of a second virtual speaker with respect to an actual speaker position, the first and said second virtual speaker positioning means causing the first and second virtual speakers to be positioned so as to define a sound field enlarged with respect to a sound field defined by the actual speaker positions;

a first mixing means for coupling a portion of the output from the first signal generation means and a portion of the output from the second signal generation means to the first virtual speaker positioning means in accordance with a first mixing ratio;

a second mixing means for coupling a portion of the output from the first signal generation means and a portion of the output from the second signal generation means to the second virtual speaker positioning means in accordance with a second mixing ratio;

a third mixing means for mixing a first signal output by the first virtual speaker positioning means with a first signal output by the second virtual speaker positioning means; and a fourth mixing means for mixing a second signal output by the first virtual speaker positioning means with a second signal output by the second virtual speaker positioning means, wherein a position of a generated audio signal is localized away from the first and second virtual speaker positions in accordance with the first and second mixing ratios.

7. The sound image position control apparatus of claim 6, wherein the first virtual speaker positioning means comprises a delay circuit, the second signal output by the first virtual speaker positioning means being delayed with respect to the first signal output by the first virtual speaker positioning means, and wherein the second virtual speaker positioning means comprises a delay circuit, the first signal output by the second virtual speaker positioning means being delayed with respect to the second signal output by the second virtual speaker positioning means.

8. The sound image position control apparatus of claim 7, further comprising a crosstalk cancellation circuit coupled to the third mixing means and the fourth mixing means.

9. A sound image position control apparatus comprising:

a first signal generation means for generating a signal corresponding to a first predetermined audio frequency range;

a second signal generation means for generating a signal corresponding to a second predetermined audio frequency range, wherein the second predetermined audio frequency range is distinct from the first predetermined audio frequency range;

a first virtual speaker positioning means for defining a position of a first virtual speaker with respect to an actual speaker position, wherein the first virtual-speaker position control means comprises:

a delay circuit having two delay times, the delay circuit delaying an input mixed signal by each of the delay times so as to output two delayed signals; and an allocation ratio applying means for applying a predetermined allocation ratio to the delayed signals, thus allocating the delayed signals to respective right-side and left-side speaker channels;

a second virtual speaker positioning means for defining a position of a second virtual speaker with respect to an actual speaker position, the first and said second virtual speaker positioning means causing the first and second virtual speakers to be positioned so as to define a sound field enlarged with respect to a sound field defined by the actual speakerpositions;

a first mixing means for coupling a portion of the output from the first signal generation means and a portion of the output from the second signal generation means to the first virtual speaker positioning means in accordance with a first mixing ratio; and a second mixing means for coupling a portion of the output from the first signal generation means and a portion of the output from the second signal generation means to the second virtual speaker positioning means in accordance with a second mixing ratio, wherein a position of a generated audio signal is localized away from the first and second virtual speaker positions in accordance with the first and second mixing ratios.

10. A sound image position control apparatus comprising:

a plurality of real speakers, each of which converts a signal input thereto into a sound;

a plurality of virtual speaker forming circuits coupled to the real speakers so as to define a virtual speaker sound field enlarged with respect to a sound field defined by positions of the plurality of real speakers, each of the plurality of virtual speaker forming circuits processing a signal input thereto so that a sound generated by at least two of the real speakers is localized at a position of a corresponding virtual speaker; and a distributing circuit which receives an input signal and then distributes it among at least two of the virtual speaker forming circuits at a distribution ratio determined in accordance with a frequency characteristic of the input signal, wherein a sound having a frequency range corresponding to the input signal is localized at a position in a space including the positions of at least two virtual speakers in accordance with the distribution ratio, and wherein each of the plurality of virtual speaker forming circuits includes a delay circuit which applies different delay times to a signal input to the virtual speaker forming circuits so as to produce two signals having different respective delay times, and a level control circuit which controls amplitude levels of the two signals output by the delay circuit.

11. A sound image position control apparatus according to claim 10, wherein the plurality of virtual speaker forming circuits comprise a finite-impulse-response digital filter.

12. A sound-image position control apparatus according to claim wherein the distributing circuit includes distribution control means which controls the distribution rate to change a localization position of the sound between the positions of the at least two virtual speakers.

13. A sound image position control apparatus comprising:

a plurality of real speakers, each of which converts a signal input thereto into a sound;

a plurality of virtual speaker forming circuits coupled to the real speakers so as to define a virtual speaker sound field enlarged with respect to a sound field defined by positions of the plurality of real speakers, each of the plurality of virtual speaker forming circuits processing a signal input thereto so that a sound generated by at least two of the real speakers is localized at a position of a corresponding virtual speaker; and a distributing circuit which receives an input signal and then distributes it among at least two of the virtual speaker forming circuits at a distribution ratio determined in accordance with a frequency characteristic of the input signal.

wherein a sound having a frequency range corresponding to the input signal is localized at a position in a space including the positions of at least two virtual speakers in accordance with the distribution ratio, and wherein each of the plurality of virtual speaker forming circuits generates a right-side and a left-side signals by processing the signal input thereto, the fight-side and left-side signals being respectively supplied to the at least two of the real speakers.

14. A sound-image position control apparatus according to claim 10, further comprising a cross-talk canceling circuit coupled between the real speakers and the virtual-speaker forming circuits, for reducing the cross-talk included in the sounds produced by the real speakers.

* * * * *

UNITED STATES PATENT AND TRADEMARK OFFICE

CERTIFICATE OF CORRECTION

PATENT NO. : 5,581,618
DATED : December 3, 1996
INVENTOR(S) : Sekine Satoshi, et. al.

It is certified that error appears in the above-indentified patent and that said Letters Patent is hereby corrected as shown below:

Title page, item [75], Inventors: the third inventor's name should be deleted, "Yasutake Susuki.

Signed and Sealed this

Twenty-third Day of September, 1997

*Attest:*

*Attesting Officer*

BRUCE LEHMAN

*Commissioner of Patents and Trademarks*